US005332459A

United States Patent [19]

Imai et al.

[11] Patent Number: 5,332,459

[45] Date of Patent: Jul. 26, 1994

[54] THERMAL TRANSFER PRINTING METHOD USING INTERMEDIATE SHEETS

[75] Inventors: Akihiro Imai, Ikoma; Yasuo Fukui, Kadoma; Nobuyoshi Taguchi, Ikoma, all of Japan

[73] Assignee: Matsushita Electric Industrial Co., Ltd., Osaka, Japan

[21] Appl. No.: 725,669

[22] Filed: Jul. 3, 1991

[30] Foreign Application Priority Data

Jul. 4, 1990 [JP] Japan ..... 2-176720
Oct. 30, 1990 [JP] Japan ..... 2-293839

[51] Int. Cl.[5] ..... B41M 5/26
[52] U.S. Cl. ..... 156/234; 156/235; 156/238; 156/240
[58] Field of Search ..... 156/230, 231, 234, 235, 156/238, 239, 240

[56] References Cited

U.S. PATENT DOCUMENTS

| | | | |
|---|---|---|---|
| 4,315,790 | 2/1982 | Rattee et al. | 156/230 |
| 4,322,461 | 3/1982 | Raphael et al. | 156/235 |
| 4,902,594 | 2/1990 | Platzer | 156/230 |
| 4,923,848 | 5/1990 | Akada et al. | 156/235 |
| 4,948,446 | 8/1990 | Yamahata et al. | 156/238 |

FOREIGN PATENT DOCUMENTS

| | | |
|---|---|---|
| 64-87390 | 3/1989 | Japan . |
| 2-38056 | 2/1990 | Japan . |

OTHER PUBLICATIONS

Derwent Abstract, Accession No. 76-38739X, London.
Derwent Abstract, Accession No. 88-93940, London.

*Primary Examiner*—Jill L. Heitbrink
*Attorney, Agent, or Firm*—Wenderoth, Lind & Ponack

[57] ABSTRACT

The present invention is directed to a thermal transfer printing process comprising:

heating a thermal ink film with a printing head to print dye transferring images onto an intermediate sheet which comprises a substrate and a printing layer thereon, heaping an image receive sheet on said printing layer, and transferring said printing layer onto an image receive sheet by pressure or heat;

The improvement residing in that said printing layer is formed from polyvinyl acetal.

The present invention also provides an intermediate sheet for the above thermal transfer printing process comprising a substrate and a printing layer on said substrate wherein said printing layer is formed from polyvinyl acetal.

7 Claims, 2 Drawing Sheets

THERMAL TRANSFER PRINTING METHOD USING INTERMEDIATE SHEETS

FIELD OF THE INVENTION

The present invention relates to a thermal transfer printing method and intermediate sheets used therefor. More particularly, it relates to an improvement of a thermal transfer printing method, which makes it possible to print on plain paper, and intermediate sheets which are used for the method.

BACKGROUND OF THE INVENTION

Thermal transfer printing is a method wherein a thermal ink film is heaped on an image receive sheet and heated by a thermal head to print images directly onto a receive sheet. When a sublimable dye is employed in this method, it is known to the art that the obtained image properties are very good like photographs. The photograph-like image, however, is not obtained when the receive sheet is plain paper, because the plain paper has rough surface and it is difficult to fix the image on it. In order to obtain the photograph-like image, it is necessary that particular paper sheets have a printing layer onto which the sublimable dye is easily fixed. It is, however, desired to form the photographical image on plain paper.

In order to satisfy this desire, it is proposed that the images are preliminarily transferred on an intermediate sheet having a printing layer and then only the printing layer is transferred onto a receive sheet (see U.S. Pat. No. 4,923,848). In this process, the intermediate sheet and the thermal ink film are sandwiched between the thermal head and a platen roller under a certain pressure, and thermal printing is conducted. Among the thermal transfer printing, the method employing the sublimable dye requires energy several times larger than the conventional hot melt type thermal transfer printing process. It is therefore required that the printing layer on the intermediate sheet be anchored on the substrate of the intermediate sheet even after such higher energy printing. Since the sublimable thermal transfer printing is generally applied for full color printing, the heating step with the thermal head should be conducted at least three times, after which the printing layer is required to be anchored on the substrate of the intermediate sheet. Contrary to this step, the printing layer is adhered onto the receive sheet by heat or pressure and then the substrate of the intermediate sheet is necessary to be peeled off in the next step. It is therefore required that the printing layer of the intermediate sheet have two properties which are in conflict with each other. Especially in the sublimable dye, if the color layer of the ink film and the printing layer have high heat resistance, printing sensitivity significantly lowers. Both layers should be prepared from a material having lower heat resistance, and therefore easily gives rise to problems of heat fusion between the printing layer and the color layer of the ink film or between the printing layer and the substrate of the intermediate sheet.

It is proposed that the printing layer is prepared from saturated polyester resin. However, since the substrate to be covered with the printing layer is generally formed from polyester, the adhesion power between the polyester printing layer and the polyester substrate is quite strong and therefore difficult to peel the substrate off after attaching the printing layer onto the receive sheet. It is also considered that a releasing layer is disposed between the printing layer and the substrate. The releasing layer in turn allows the printing layer to transfer onto the thermal ink film during heat printing with the thermal head.

In order to promote to adhering the printing layer onto the receive sheet or to inhibit transferring the printing layer onto the color layer of the ink film, it is proposed that an adhesive layer is disposed either between the printing layer and the substrate of the intermediate layer or on the surface of the printing layer. Since the adhesive layer is thermoplastic at ambient temperature, the printed images in the printing layer often bleed into the adhesive layer. The adhesive layer also has adhesive properties to everything and may give rise to mechanical operation and treatment problems.

SUMMARY OF THE INVENTION

In the intermediate sheet, the printing layer is very important and should have some properties which are in conflict with each other. The printing layer is formed from a material which is easily dyed with a sublimable dye, but which hardly-adheres with the thermal ink film. The printing layer also adheres on the substrate of the intermediate sheet during thermal printing, but should adhere to the receive sheet and is easily peeled off from the substrate.

The present invention, accordingly, is directed to a thermal transfer printing process comprising:

heating a thermal ink film with a printing head to print dye transferring images onto an intermediate sheet which comprises a substrate and a printing layer thereon, heaping an image receive sheet on said printing layer, and transferring said printing layer onto the image receive sheet by pressure or heat;

an improvement residing in that said printing layer is formed from polyvinyl acetal.

The present invention also provides an intermediate sheet for the above thermal transfer printing process comprising a substrate and a printing layer on said substrate wherein said printing layer is formed from polyvinyl acetal.

DETAILED DESCRIPTION OF THE INVENTION

Figure 1:
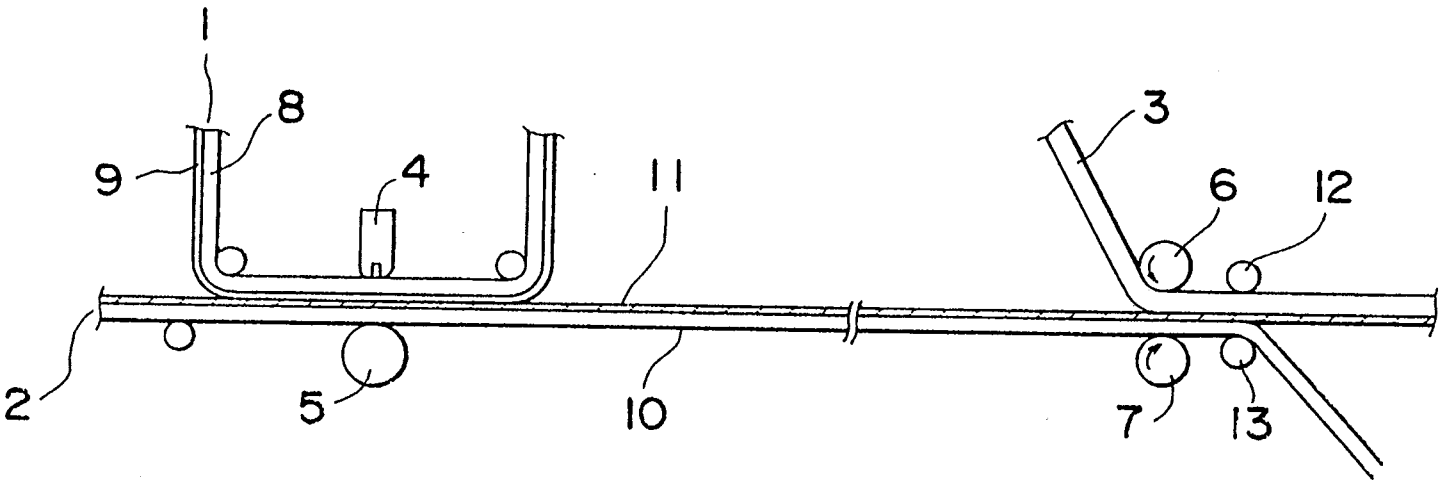
FIG. 1 is a schematic view illustrating the thermal transfer printing process of the present invention.

FIG. 1 is a schematic view which illustrates the thermal transfer printing process of the present invention. FIG. 1, of course, is not to be construed as limiting the present invention to its detailed system, in number of rollers, platen rollers, printing heads and the like.

A thermal ink film 1 is heaped with an intermediate sheet 2 so that a color layer 9 of the thermal ink film 1 is faced with a printing layer 11 of the intermediate sheet 2, and then sandwiched between a printing head 4 and a platen roller 5 under a certain pressure. Printing informations are sent to the printing head 4 from an information processing system which is not shown in FIG. 1, and then printed on the printing layer 11. The traveling speeds of the thermal ink film i and the intermediate sheet 2 may be the same or different.

In case of obtaining full color images, for example, the process of the above mentioned process is repeated with the thermal ink film which has cyan, magenta and yellow color layer. Also, a plural of printing heads may be used for the full color images.

The printing head is not limited as long as the color dye in the color layer 9 is sublimated or diffused onto the printing layer 11. Examples of the printing heads are a thermal head, an electrode head, a light head and the like.

Subsequently, the intermediate sheet 2 is heaped with an image receive sheet 3 so that the printing layer 11 is faced with the surface of the receive sheet 3, and pressed or heated to transfer or adhere the printing layer 11 onto the image receive sheet 3. The substrate 10 of the the intermediate sheet 2 may be peeled off simultaneously with the transferring or afterward. Heating or pressing may be provided by passing the intermediate sheet 2 and the image receive sheet 3 between mediums of which at least one is heated or between mediums which are pressed with each other. Heating may be carried out by a light source which has a high radiant heat. In FIG..1, two heat rollers 6 and 7 are employed. The heat rollers may be rubber covered rollers, plastic rollers, metal rollers and the like. The heating or pressing method is not limited as long as the printing layer is transferred onto the image receive sheet, but preferred is a combination of rollers of which at least one is a heat roller. More preferred is a combination of a resilient roller (rubber covered roller) and a metal roller, or a combination of two resilient rollers. A temperature of heating is not limited, but generally is within the range of room temperature to 300° C. An amount of pressure is not limited, but generally is less than $10^8$ pa.

Figure 2:
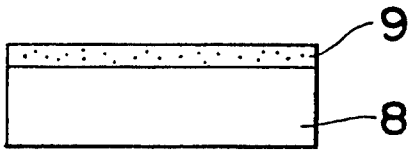
FIG. 2 is a sectional view of the thermal ink film.
Figure 3:
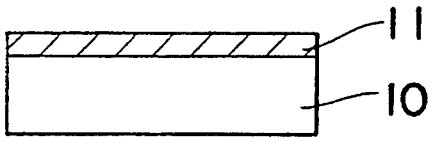
FIGS. 3–6 are sectional views which show several embodiments of the intermediate sheet of the present invention.

FIG. 2 shows a schematic sectional view of the thermal ink film 1 which is employed in the present invention. The thermal ink film 1 is at least composed of a substrate 8 and the color layer 9. The substrate 8 can be formed from a material which is known to the art, including a polymer film, a surface treated polymer film, an electroconductive film and the like. Examples of the polymer films are polyolefin, polyamide, polyester, polyimide, polyether, cellulose, poly(parabanic acid), polyoxadiazole, polystyrene, fluorine-containing film and the like. Preferred are polyethylene terephthalate, polyethylene naphthalate, alamide, triacetyl cellulose, poly(parabanic acid), polysulfone, polypropylene, cellophane, moistureproof cellophane and polyethylene. It is preferred that at least one side of the substrate is covered with a heat resistance layer, a lubricant layer (or a lubricant electroconductive layer) and a lubricant heat resistance layer (or a lubricant heat resistance electroconductive layer) to enhance heat resistance and traveling stability of the thermal ink film. Examples of the electroconductive films are a polymer film containing electroconductive particles (e.g. carbon black or metal powder), a polymer film on which an electroconductive layer is formed, a polymer film on which an electroconductive vapor deposition layer is formed, and the like. It is also preferred that an anchor coat is present between the color layer and substrate 8 to prevent the color layer 9 from peeling off.

The color layer 9 is mainly composed of a dyestuff and a binder. The dyestuff is not limited, including a disperse dye, a basic dye, a color former and the like. The binder includes acryl resins, styrene resins, urethane resins, polyester resins, polyvinyl acetal resins, vinyl acetate resins, chlorinated resins, amide resins, cellulose resins and the like. Examples of the cellulose resins are methyl cellulose, ethyl cellulose, hydroxyethyl cellulose, carboxymethyl cellulose, nitrocellulose, acetic cellulose and the like. Preferred binders are acrylonitrile-styrene copolymer, polystyrene, styrene-acryl copolymer, saturated polyester, polyester-urethane, vinyl chloride resin, chlorinated vinylchloride resin, vinyl chloride-vinyl acetate copolymer (which is further copolymerized with vinyl alcohol,. maleic acid and the like), vinyl chloride-acrylate copolymer (of which acrylate may be a mixture), vinyl acetate resin, rubber chloride, chlorinated polypropylene, polycarbonate and cellulose resins, because printing sensitivity is high and they effectively prevent the color layer from fusing. The copolymer may be prepared from three monomers. The binder may also be polyvinyl acetals, such as polyvinyl formal, acetoacetalized polyvinyl alcohol, propionacetalized polyvinyl alcohol, polyvinyl butyral and the like. It is preferred that the binder has a glass transition temperature of 40° to 150° C. and an average polymerization degree of 200 to 2,700.

The color layer may further contain fluorine-containing moisture curable resins or siloxane-containing moisture curable resins to prevent heat fusing. The fluorine-containing moisture curable resins or siloxane-containing moisture curable resins include moisture curable resins which contain hydrolyzable silyl groups (see Japanese Patent Application Ser. No. 144241/1988); and moisture curable resins which contain hydrolyzable isocyanate groups into which fluorine or silicon is introduced. The fluorine-containing moisture curable resins include fluorine-containing polymer having hydrolyzable silyl groups, for example moisture curable resins as described in Japanese Kokai Publication 558/1987, especially fluorine-containing acryl silicon resin; or fluorine-containing polyurethane resin having hydrolyzable isocyanate group at terminals or side chains. The siloxane-containing moisture curable resins include siloxane-containing vinyl polymers having hydrolyzable silyl groups, especially siloxane-containing acryl silicon resins; or siloxane-containing polyurethane resins having hydrolyzable isocyanate groups at terminals or side chains. The fluorine-containing moisture curable resins or siloxane-containing moisture curable resins may be modified with urethane resins. Examples of the fluorine-containing acryl silicon resins are fluorine-containing acryl silicon resins available from Sanyo Chemical Industries Ltd. as F-2A. Examples of the siloxane-containing acryl silicon resins are siloxane-containing acryl silicon resin available from Sanyo Chemical Industries Ltd. as F-6A. Examples of the siloxane-containing moisture curable resins having hydrolyzable isocyanate groups are siloxane-containing moisture curable resins available from Sinko Technical Research CO., LTD. as SAT-300P.

The color layer 9 may further contain a reaction promoter for the moisture curable resin, if necessary. Examples of the reaction promoters are titanares (e.g. alkyl titanate), amines (e.g. dibutylamine-2-hexoate), organic tin compounds (e.g. tin octylate, dibutyltin dilaurate, dibutyltin maleate), acidic compounds and catalysts as described in Japanese Kokai Publication 19361/1983. An amount of the reaction promoter is within the range of 0.001 to 100% by weight based on the amount of the resin.

The color layer 9 may also contain a storage stabilizer in case where the moisture curable resin is used as a coating composition. Examples of the storage stabilizers are as described in Japanese Kokai Publication 51724/1985 and 147511/1982.

The color layer 9 is composed of plural layers. Also, a lubricating layer or another layer may be formed on the color layer. The uppermost layer may preferably contain the fluorine-containing moisture curable resins, siloxane-containing moisture curable resins, or the other silicon or fluorine materials or antistatic agents.

FIGS. 3–6 are sectional views which show several embodiments of the intermediate sheet of the present invention.

The intermediate sheet 2 is mainly composed of the substrate 10 and the printing layer 11. The substrate is not limited, including paper having a smooth surface, a polymer film and an electroconductive film. The polymer film and the electroconductive is the same as mentioned above for the substrate 8 of the thermal ink film. On the substrate 10, various coatings as described in the explanation of the substrate 8 (e.g. heat resistance layer and the like) may be disposed. The substrate 10 preferably has a thickness of 2 to 100 micrometer.

The printing layer 11 is mainly prepared from polyvinyl acetal. The polyvinyl acetal is a resin which is prepared by reacting polyvinyl alcohols with aldehydes (e.g. formaldehyde, acetoaldehyde, propionaldehyde, butyraldehyde and the like). Typical examples of the polyvinyl acetals are polyvinyl formal, acetoacetalized polyvinyl alcohol, propionacetalized polyvinyl alcohol, polyvinyl butyral and the like. The polyvinyl acetal has superior dyeing ability for a disperse dye, because it has polar groups which are acetal constructions. The acetal construction has a hydrogen atom or an alkylidene group. It is preferred that the polyvinyl acetal has a high acetalization degree and the alkylidene group has 3 carbon atoms or more., because such polyvinyl acetal effectively prevents heat fusion. Also, the polyvinyl acetal having high acetalization degree and an alkylidene group having at least three carbon atoms has a low glass transition Temperature, thus resulting in high printing sensitivity. Since the polyvinyl acetal has poor adhesive properties with polyester film, it is easily removable from the polyester substrate. However, when printing the printing images on the printing layer, the printing layer is heated more than the glass transition temperature and softened so as to adhere to the polyester film. Even in the softened condition, the polyvinyl acetal has insufficient adhesion to adhere to the thermal ink film. It is believed that this is the reason why the polyvinyl acetal remains on the substrate 10 when printing. Once printing has finished, the polyvinyl acetal layer contains dye and lowers its softening point in comparison with that not containing dye. Accordingly, when the polyvinyl acetal layer 11 is contacted with the image receive sheet 3, it is easily adhered onto the sheet 3. If the image receive sheet 3 is plain paper, the polyvinyl acetal is coiled with the paper matrix to promote the transferring. This is the reason why the polyvinyl acetal layer is stuck on the substrate 10 when printing by the printing head and transferred onto the image receive sheet 3 during the next transferring step. The polyvinyl acetal preferably has an average polymerization degree of 2,700 or less, more preferably less than 1,500. It is also preferred that the polyvinyl acetal has a flow softening point of 250° C. or less, more preferably 200° C. or less. The flow softening point (or flow beginning temperature) is determined by a flow tester (temperature rise rate=6° C./min, extruding pressure=9.8×106 Pa, die=1 mm (pore diameter)×10 mm). The polyvinyl acetal which satisfies the range mentioned above has good printing sensitivity and good transferability to the image receive sheet. Since the polyvinyl acetal which has a higher acetalization degree exhibits a higher heat fusion prevention properties, it is desired that the acetalization degree is 50 mol % or more. It is most preferred that the polyvinyl acetal is polyvinyl butyral which has a butyralization degree of 50 mol % or more, because it has excellent heat fusion preventive properties and printing sensitivity. Suitable polyvinyl butyral is commercially available from Sekisui Chemical Co., Ltd. as BL-1 (butyralization degree=63±3 mol %, flow softening point=105° C.), BL-2 (-butyralization degree=63±3 mol %, flow softening point=120° C.), BH-S (butyralization degree=70 mol % or more, flow softening point=160° C.), BM-S (butyralization degree=70 mol % or more, flow softening point=150° C.), BL-S (butyralization degree=70 mol % or more, flow softening point=110° C.), BH-3 (butyralization degree=65±3 mol %, flow softening point=205° C.) BM-2 (butyralization degree=68±3 mol % flow softening point=140° C.), BM-1 (butyralization degree=65±3 mol % flow softening point=130° C.), BM-5(butyralization degree=65±3 mol % flow softening point=160° C.) and the like. The polyvinyl acetal may be reacted with phenol resin, epoxy resin, melamine resin, isocyanate compound or dialdehyde compound to form a crosslinked structure. The polyvinyl acetal has no stickiness at an ambient temperature and therefore has no bleeding and is easily treated.

In addition to the main components, the printing layer may also contain fluorine-containing moisture curable resins or siloxane-containing moisture curable resins to prevent heat fusion. Examples of the fluorine-containing moisture curable resins or siloxane-containing moisture curable resins are the same as mentioned in the thermal ink film. The addition of the fluorine-containing moisture curable resins or siloxane-containing moisture curable resins is very preferred, because the heat fusion between the thermal ink film and the printing layer would not occur. The printing layer may further contain other resins, such as acryl resins, urethane resins, polyester resins, vinyl acetate resins, chlorinated resins, styrene resins, cellulose resins and the like. Preferred are acrylonitrile-styrene copolymer resin, polystyrene, styrene-acryl copolymer resin, saturated polyester, polyester-urethane, vinyl chloride resin, chlorinated vinyl resin, rubber chloride, chlorinated polypropylene, polycarbonate, vinyl chloride-vinyl acetate resin, vinyl chloride-acrylic ester copolymer and vinyl acetate resin.

Figure 4:
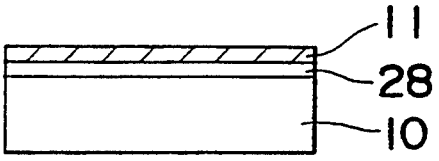
Figure 5:
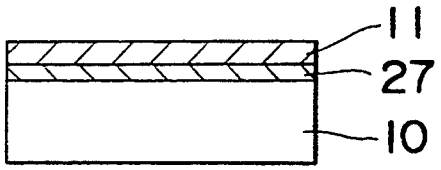
Figure 6:
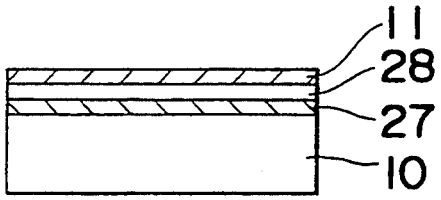

If necessary, either a polymer material layer 28 or a releasing layer 27 or both are disposed between the substrate 10 and the printing layer 11 (see FIGS. 4–6). The polymer material layer is prepared from thermoplastic resins or curable resins by means of heat, light or electron beam. The polymer material includes acryl resins, urethane resins, amide resins, ester resins, cellulose resins, styrene resins and the like. Preferred polymer materials are polyvinyl alcohol, polyvinyl alcohol derivatives, cellulose derivatives, modified starch, starch derivatives, chlorinated resin and polycarbonate, because they have good solvent resistance to aromatic hydrocarbons or ketones which are used for the printing layer and have poor adhesive properties with polyester films which are typically used for the substrate 10. Examples of the polyvinyl alcohol derivatives are polyvinyl acetal and the like. Examples of the cellulose derivatives are methyl cellulose, ethyl cellulose, hydroxyethyl cellulose, carboxymethyl cellulose, nitrocellulose, acetic cellulose and the like. Examples of the processed starches are oxide starch, enzyme-treated starch and the like. Examples of the starch derivatives are hydroxyethyl starch, carboxymethyl starch, cyanoethylated starch and the like. Examples of the chlorinated resins are rubber chloride, chlorinated polyethylene, chlorinated polypropylenee and the like. These polymers are not sticky at an ambient temperature and have no bleeding properties. The polymer material preferably has a glass transition temperature of more than 50° C. in view of the reliability of the printed images. In order to coil the polymer material into the paper matrix, the polymer material preferably has an average polymerization degree of 200 to 2,700, more preferably 200 to 1,500 or a flow softening point of 80 to 250° C., more preferably 80 to 200° C. The polymer material may further contain the fluorine-containing moisture curable resins or siloxane-containing moisture curable resins to prevent heat fusion.

The releasing layer 27 mainly contains a releasing agent or a combination of the releasing agent and a polymer binder. The releasing agent includes the fluorine-containing moisture curable resins, siloxane-containing moisture curable resins, other silicone releasing agents and fluorine releasing agents. The fluorine-containing moisture curable resins or siloxane-containing moisture curable resins are the same as mentioned above. Typical examples of the other silicone releasing agents are dimethylsilicone oil, phenylsilicone oil, fluorine-containing silicone oil, modified silicone oil (e.g. modified with SiH, silanol, alkoxy, epoxy, amino, carboxyl, alcohol, mercapt, vinyl, polyether, fluorine, higher fatty acid, carnauba, amide or alkylallyl), silicone rubber, silicone resin, silicone emulsion and the like. Typical examples of the other fluorine releasing agents are fluorine resins (e.g. polytetrafluoroethylene, tetrafluoroethylene-perfluoroalkyl vinyl ether copolymer), fluorine rubbers (e.g. vinylidene fluoride-hexafluoropropylene rubber), fluorine surfactants, fluoride carbons, fluorine rubber latex and the like. The releasing agent also includes fatty acid esters, waxes and oils. The polymer binder can be the polymer listed in the polymer material layer 28.

The releasing layer 27 and the polymer material layer 28 may contain antistatic agents.

The printing layer 11 is required to have writing properties and therefore may contain micro particles, such as synthetic amorphous silica, titanium oxide, calcium carbonate, alumina; or transparent micro particles. I t may further contain a ultraviolet absorber, an antioxidant and a fluorescent agent.

The polymer material layer 28 is preferably transparent, because this layer is transferred onto the image receive sheet 3 together with the printing layer 11. The polymer material layer 28 may contain micro particles, such as synthetic amorphous silica, titanium oxide, calcium carbonate, alumina; or transparent micro particles to impart writing properties. It may further contain a ultraviolet absorber, an antioxidant and a fluorescent agent, because this layer functions as a protective layer for the printed images. The polymer material layer 28, if necessary, may contain an agent to develop color of the dye in the thermal ink film.

The color layer 9, the printing layer 11 or the polymer material layer 28 may contain one or more releasing agents. The releasing agent is the silicone or fluorine releasing agent as described in the releasing layer 27.

The image receive sheet 3 is not limited in material, quality and shape, including non-coated paper, coated paper, film, sheet, synthetic paper, continuous sheet or cut sheet. The image printed in the receive sheet 3 is a mirror image to the image printed on the printing layer 11, because the printing layer 11 is transferred onto the receive sheet 3. Accordingly, the informations to be sent to the printing head should take into consideration this mirror image.

According to the present invention, printing photographic images can be possible on various kind of paper, such as plain paper, transparent film for OHP, bond paper, coated paper and non-coated paper. The process of the present invention is very simple and easily treated.

EXAMPLES

The present invention is illustrated by the following Examples which, however, are not to be construed as limiting the present invention to their details.

EXAMPLE 1

Preparation of a Thermal Ink Film

A polyethylene terephthalate (hereinafter "PET") film with 4 micrometer thickness, which had a lubricant heat resistance layer on one side and an anchor layer on the other side, was coated by a wire bar with a paint prepared from the following ingredients on the anchor layer side to form a color layer with about 1 micrometer.

| Ingredients | Parts by weight |
|---|---|
| Azo disperse dye | 2.8 |
| Acrylonitrile-styrene copolymer | 4 |
| Amide-modified silicone oil | 0.04 |
| Toluene | 25 |
| 2-Butanone | 25 |

Preparation of an Intermediate Sheet

A PET film with 9 micrometer thickness was coated by a wire bar with a paint prepared from the following ingredients.

| Ingredients | Parts by weight |
|---|---|
| Polyvinyl butyral resin*1 | 4 |
| Siloxane acryl silicon resin*2 | 0.23 |
| D-n-butyltin dilaurate | 0.0012 |
| Toluene | 18 |
| 2-Butanone | 18 |

*1Available from Sekisui Chemical Co., Ltd. as BL-S having a polymerization degree of 350.
*2Available from Sanyo Chemical Industries, Ltd. as F-6A-4 having 54 wt % active ingredients.

The coated film was dried and then heated at 100° C. for 30 minutes to form a color layer having about 2 micrometer.

The resulting intermediate sheet was heaped with the thermal ink film so that the color layer was faced with the printing layer, and then sandwiched between a thermal head and a platen roller under a pressure of about 3 Kg. Printing was conducted by the following conditions;

| | |
|---|---|
| Printing rate | 33.3 ms/line |
| Printing pulse width | 2–8 ms |
| Maximum printing energy | 6 J/cm$^2$ |

After printing, the intermediate sheet was removed from the thermal ink film and gradation patterns were printed on the printing layer without any heat fusion. Subsequently, a plain paper (wood free paper) was heaped on the printing layer and passed at about 180° C. between a rubber covered metal roller and a metal roller under a pressure of about 5 Kg. The PET substrate sheet was removed to find that the printed printing layer was adhered on the plain paper.

The printed image had a reflective printing density of 1.6 at a pulse width 8 ms and was a high quality image having uniform dots from the lower printing density to the higher printing density. The printed image was left at 60° C. and 60% relative humidity for 200 hours, but no bleeding was observed.

EXAMPLE 2

Preparation of a Thermal Ink Film

A polyethylene terephthalate (hereinafter "PET") film with 4 micrometer thickness, which had a lubricant heat resistance layer on one side and an anchor layer on the other side, was coated by a wire bar with a paint prepared from the following ingredients on the anchor layer side to form a color layer with about 1 micrometer.

| Ingredients | Parts by weight |
|---|---|
| Azo disperse dye | 2.8 |
| Polyvinyl butyral resin*3 | 4 |
| Amide-modified silicone oil | 0.04 |
| Toluene | 25 |
| 2-Butanone | 25 |

*3Available from Sekisui Chemical Co., Ltd. as BH-S.

Preparation of an Intermediate Sheet

A PET film with 9 micrometer thickness was coated by a wire bar with a paint prepared from the following ingredients.

| Ingredients | Parts by weight |
|---|---|
| Polyvinyl butyral resin*1 | 4 |
| Fluorine containing acryl silicon resin*4 | 0.83 |
| D-n-butyltin dilaurate | 0.004 |
| Toluene | 18 |
| 2-Butanone | 18 |

*1Available from Sekisui Chemical Co., Ltd. as BL-S having a polymerization degree of 350.
*4Available from Sanyo Chemical Industries, Ltd. as F-2A having 48 wt % active ingredients.

The coated film was dried and then heated at 100° C. for 30 minutes to form a color layer having about 2 micrometer.

Printing was conducted as generally described in Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a pressure between rollers was about 50 Kg. The PET substrate sheet was removed to find that the printed printing layer was adhered on the plain paper.

The printed image had a reflective printing density of 1.7 at a pulse width 8 ms and was a high quality image having uniform dots from the lower printing density to the higher printing density. The printed image was left at 60° C. and 60% relative humidity for 200 hours, but no bleeding was observed.

EXAMPLE 3

Printing and transferring were conducted as generally described in Example 1 with the exception that the receive sheet was changed to an OHP film. The substrate sheet of the intermediate sheet was removed to find that the printed printing layer was adhered on the OHP film.

The printed image had a reflective printing density of 0.88 at a pulse width 8 ms and was a high quality image having uniform dots from the lower printing density to the higher printing density. The printed image was left at 60° C. and 60% relative humidity for 200 hours, but no bleeding was observed.

EXAMPLE 4

Printing and transferring were conducted as generally described in Example 1 with the exception that the receive sheet was changed to a bond paper (cotton 100%). The substrate sheet of the intermediate sheet was removed to find that the printed printing layer was adhered on the bond.

The printed image had a reflective printing density of 1.58 at a pulse width 8 ms and was a high quality image having uniform dots from the lower printing density to the higher printing density. The printed image was left at 60° C. and 60% relative humidity for 200 hours, but no bleeding was observed.

EXAMPLE 5

Preparation of a Thermal Ink Film

A polyethylene terephthalate (hereinafter "PET") film with 4 micrometer thickness, which had a lubricant heat resistance layer on one side and an anchor layer on the other side, was coated by a wire bar with a paint prepared from the following ingredients on the anchor layer side and heated at 60° C. for one hour to form a color layer with about 1 micrometer.

| Ingredients | Parts by weight |
|---|---|
| Azo disperse dye | 2.8 |
| Acrylonitrile styrene copolymer resin | 4 |
| Siloxane containing acryl silicon resin solution*5 | 0.5 |
| Di-n-butyltin dilaurate | 0.005 |
| Toluene | 25 |
| 2-Butanone | 25 |

*5Available from Sanyo Chemical Industries Ltd. as F-6A having 54 wt % active ingredients.

Preparation of an Intermediate Sheet

A PET film with 9 micrometer thickness was coated by a wire bar with a paint prepared from the following ingredients.

| Ingredients | Parts by weight |
|---|---|
| Polyvinyl butyral resin*6 | 4 |

-continued

| Ingredients | Parts by weight |
|---|---|
| Toluene | 18 |
| 2-Butanone | 18 |

*6Available from Sekisui Chemical Co., Ltd. as BM-S having a polymerization degree of about 850.

The coated film was dried to form a color layer having about 2 micrometer.

Printing was conducted as generally described in Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 200° C. The PET substrate sheet was removed to find that the printed printing layer was adhered on the plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 6

A PET film with 6 micrometer thickness was coated with a paint which contained 5 parts by weight of a polyvinyl butyral resin (available from Sekisui Chemical Industries Ltd., as BX-1 having about 1,700 polymerization degree and about 225° C. flow softening point), 50 parts by weight of toluene and 50 parts by weight of 2-butanone, to form a polymer material layer having a thickness of about 1.5 micrometer. On this polymer material layer, a paint from the following ingredients was coated with a wire bar.

| Ingredients | Parts by weight |
|---|---|
| Polyvinyl butyral resin*6 | 4 |
| Fluorine containing acryl silicon resin solution*4 | 0.24 |
| Di-n-butyltin dilaurate | 0.002 |
| Toluene | 20 |
| 2-Butanone | 20 |

The coated film was dried and heated at 100° C. for 30 minutes to form a printing layer having about one micrometer. During forming the printing layer, the polymer material layer was hardly changed with the solvent in the paint of the printing layer.

Printing was conducted as generally described in Example 1, using the thermal ink film of Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 200° C. The PET substrate sheet was removed to find that the printed printing layer was adhered together with the polymer material layer on the plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 7

A PET film with 6 micrometer thickness was coated with a paint which contained 5 parts by weight of a polyvinyl alcohol (available from Kuraray Co., Ltd. as PVA-105) and 95 parts by weight of water, to form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 8

A PET film with 6 micrometer thickness was coated with a paint which contained 5 parts by weight of an acetoacetalized polyvinyl alcohol (available from Sekisui Chemical Industries Ltd. as KS-5, having 2,400 polymerization degree), 50 parts by weight of toluene and 50 parts by weight of 2-butanone, to form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 9

A PET film wish 6 micrometer thickness was coated with a paint which contained 4 parts by weight of hydroxyethyl cellulose and 96 parts by weight of water, to form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 10

A PET film with 6 micrometer thickness was coated with a paint which contained 4 parts by weight of carboxymethyl starch, 0.02 parts by weight of polyether-modified silicone oil and 96 parts by weight of water, to form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.5 at a pulse width 8 ms and was a high quality image having uniform dots from the lower printing density to the higher printing density. The printed image was left at 60° C. and 60% relative humidity for 200 hours, but no bleeding was observed.

EXAMPLE 11

A thermal ink film was prepared as generally described in Example 5, with the exception that a vinyl chloride-vinyl acetate copolymer-resin (glass transition temperature=70° C., average polymerization degree=420) was employed instead of the acrylonitrile-styrene copolymer resin.

Then, a PET film with 6 micrometer thickness was coated with a paint which contained 10 parts by weight of a chlorinated polypropylene (available from Asahi Denka Kogyo K.K. as CP-100), 0.03 parts by weight of polyether-modified silicone oil, 50 parts by weight of toluene and 50 parts by weight of 2-butanone, no form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.7 at a pulse width 8 ms and was a high quality image having uniform dots from the lower printing density to the higher printing density. The printed image was left at 60° C. and 60% relative humidity for 200 hours, but no bleeding was observed.

EXAMPLE 12

A thermal ink film was prepared as generally described in Example 5, with the exception that a vinyl chloride-acrylic ester copolymer-resin (available from Sekisui Chemical Co., Ltd., as S-LEC E-C110, glass transition temperature=about 65° C., average polymerization degree=about 380) was employed instead of the acrylonitrile-styrene copolymer resin.

Then, a PET film with 6 micrometer thickness was coated with a paint which contained 10 parts by weight of polycarbonate and 90 parts by weight of toluene, to form a polymer material layer having a thickness of about 2 micrometer. On this polymer material layer, the paint for the printing layer of Example 6 was coated to form an intermediate sheet. During forming the printing layer, the polymer material layer was hardly changed with the solvent in the paint of the printing layer.

Printing and transferring were conducted as generally described in Example 6 to form a high quality printing on a plain paper.

The printed image had a reflective printing density of 1.67 at a pulse width 8 ms and was a high quality image having uniform dots from the lower printing density to the higher printing density. The printed image was left at 60° C. and 60% relative humidity for 200 hours, but no bleeding was observed.

EXAMPLE 13

A PET film with 9 micrometer thickness was coated by a wire bar with a paint which contained 10 parts by weight of a silicone releasing agent (available from Toray Dow Corning Silicone Co., Ltd. as PRX 305 Dispersion) and 10 parts by weight of toluene, and heated at 100° C. for one hour to form a silicone rubber releasing layer having a thickness of about 5 micrometer. On this layer, a paint from the following ingredients was coated with a wire bar.

| Ingredients | Parts by weight |
|---|---|
| Polyvinyl butyral resin*1 | 4 |
| Fluorine containing acryl silicon resin solution*4 | 0.75 |
| Di-n-butyltin dilaurate | 0.004 |
| Toluene | 18 |
| 2-Butanone | 18 |

The coated film was dried and heated at 100° C. for 30 minutes to form a printing layer having about one micrometer. During forming the printing layer, the polymer material layer was hardly changed with the solvent in the paint of the printing layer.

Printing was conducted as generally described in Example 2, using the thermal ink film of Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 180° C. The PET substrate sheet coated releasing layer was removed to find that the printed printing layer was adhered on the plain paper.

The printed image had a reflective printing density of 1.6 at a pulse width 8 ms and was a high quality image having uniform dots from the lower printing density to the higher printing density. The printed image was left at 60° C. and 60% relative humidity for 200 hours, but no bleeding was observed.

EXAMPLE 14

A PET film with 6 micrometer thickness was coated by a wire bar with a paint which contained 10 parts by weight of a silicone coating agent (available from Toray Dow Corning Silicone Co., Ltd. as SE9157RTV) and 15 parts by weight of toluene, and heated at 100° C. for one hour to form a silicone rubber releasing layer having a thickness of about 5 micrometer. On this layer, a paint from the following ingredients was coated with a wire bar to form a polymer material layer having about 1.5 micrometer thickness.

| Ingredients | Parts by weight |
|---|---|
| Polyvinyl butyral resin*7 | 5 |
| Toluene | 50 |

-continued

| Ingredients | Parts by weight |
|---|---|
| 2-Butanone | 50 |

*7Available from Sekisui Chemical Co., Ltd. as BL-2 having about 450 polymerization degree.

A paint from the following ingredients was further coated thereon with a wire bar.

| Ingredients | Parts by weight |
|---|---|
| Polyvinyl butyral resin*3 | 4 |
| Fluorine containing acryl silicon resin solution*4 | 0.67 |
| Di-n-butyltin dilaurate | 0.003 |
| Toluene | 20 |
| 2-Butanone | 20 |

The coated film was dried and heated at 100° C. for 30 minutes to form a printing layer having about one micrometer. During forming the printing layer, the polymer material layer was hardly changed with the solvent in the paint of the printing layer.

Printing was conducted as generally described in Example 2, using the thermal ink film of Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 210° C. The PET substrate sheet coated releasing layer was removed to find that the printed printing layer was adhered together with the polymer material on the plain paper.

The printed image had a reflective printing density of 1.6 at a pulse width 8 ms and was a high quality image having uniform dots from the lower printing density to the higher printing density. The printed image was left at 60° C. and 60% relative humidity for 200 hours, but no bleeding was observed.

EXAMPLE 15

A PET film with 9 micrometer thickness was coated by a wire bar with a paint which contained the following ingredients;

| Ingredients | Parts by weight |
|---|---|
| Polyvinyl butyral resin*1 | 4 |
| Fluorine containing acryl silicon resin solution*4 | 0.83 |
| Di-n-butyltin dilaurate | 0.001 |
| Toluene | 18 |
| 2-Butanone | 18 |

and heated at 100° C. for 30 minutes to form a polymer material layer with about 2 micrometer. On this layer, a paint containing the following ingredients was coated with a wire bar.

| Ingredients | Parts by weight |
|---|---|
| Polyvinyl butyral resin*1 | 5 |
| Toluene | 18 |
| 2-Butanone | 18 |

It was then heated at 100° C. for 30 minutes to form a printing layer with about 2 micrometer.

Printing was conducted as generally described in Example 5, using the thermal ink film of Example 1. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 180° C. The PET substrate sheet was removed to find that the printed printing layer was adhered together with the polymer material on the plain paper sheet.

The printed image had a reflective printing density of 1.6 at a pulse width 8 ms and was a high quality image having uniform dots from the lower printing density to the higher printing density. The printed image was left at 60° C. and 60% relative humidity for 200 hours, but no bleeding was observed.

EXAMPLE 16

A PET film with 9 micrometer thickness was coated by a wire bar with a paint which contained the following ingredients;

| Ingredients | Parts by weight |
|---|---|
| Epoxy acrylate resin | 10 |
| Sensitizer*8 | 0.5 |
| Fluorine containing acryl silicon resin solution*4 | 1.0 |
| Di-n-butyltin dilaurate | 0.001 |
| Ethyl acetate | 90 |

*8Available from CIBA-GEIGY (Japan) Limited as Irgacure 184.

and exposed to a 4 KW high pressure mercury lamp to cure, thus forming a one micrometer releasing layer. On this layer, the printing layer paint of Example 15 was coated to form an intermediate sheet.

Printing was conducted as generally described in Example 1, using the thermal ink film of Example 5. After printing, the intermediate sheet was removed from the thermal ink film and gradation patterns were printed on the printing layer without any heat fusion. Subsequently, a plain paper was heaped on the printing layer and transferred as generally described in Example 1, with the exception that a temperature between rollers was about 180° C. The PET substrate sheet was removed to find that the printed printing layer was adhered on the plain paper sheet.

The printed image had a reflective printing density of 1.6 at a pulse width 8 ms and was a high quality image having uniform dots from the lower printing density to the higher printing density. The printed image was left at 60° C. and 60% relative humidity for 200 hours, but no bleeding was observed.

EXAMPLE 17

A thermal ink film was prepared as generally described in Example 2, with the exception that a saturated polyester (available from Toyoho Co., Ltd., as VYLON RV200, glass transition temperature=about 67° C.) was employed instead of the polyvinyl butyral resin.

Printing was conducted as generally described in Example 1, using the above obtained thermal ink film and the intermediate sheet of Example 2, to form a high quality printing without heat fusion of the ink film. It was then combined with a plain paper and transferring was conducted between two heat rollers as generally described in Example 1. After transferring, the substrate film of the intermediate sheet was removed from the plain paper to find that the printing layer was transferred onto the paper.

The printed image had a reflective printing density of 1.85 at a pulse width 8 ms and was a high quality image having uniform dots from the lower printing density to the higher printing density. The printed image was left at 60° C. and 60% relative humidity for 200 hours, but no bleeding was observed.

EXAMPLE 18

A thermal ink film was prepared as generally described in Example 2, with the exception that a vinyl acetate resin having an average polymerization degree of 530 was employed instead of the polyvinyl butyral resin.

Printing was conducted as generally described in Example 1, using the above obtained thermal ink film and the intermediate sheet of Example 2, to form a high quality printing without heat fusion of the ink film. It was then combined with a plain paper and transferring was conducted between two heat rollers as generally described in Example 1. After transferring, the substrate film of the intermediate sheet was removed from the plain paper to find that the printing layer was transferred onto the paper.

The printed image had a reflective printing density of 1.85 at a pulse width 8 ms and was a high quality image having uniform dots from the lower printing density to the higher printing density. The printed image was left at 60° C. and 60% relative humidity for 200 hours, but no bleeding was observed.

What is claimed is:

1. A thermal transfer printing process comprising:

heating a thermal ink film with a printing head to print dye transferring images onto an intermediate sheet which comprises a substrate and a printing layer thereon, heaping an image receive sheet on said printing layer, and transferring said printing layer onto said image receive sheet by pressure or heat;

wherein said thermal ink film comprises a substrate and a color layer comprising:

a dye, and a polymer binder which is selected from the group consisting of acrylonitrile-styrene copolymer, polystyrene, styrene-acryl copolymer, polyvinyl chloride, chlorinated polyvinyl chloride, polyvinyl acetate, vinyl chloride-vinyl acetate copolymer, vinyl chloride-acrylic ester copolymer, saturated polyester, polyester urethane, cellulose resin, rubber chloride, chlorinated polypropylene, polycarbonate and a mixture thereof, and wherein said printing layer is formed from polyvinyl acetal, and either said color layer or said printing layer or both contain a fluorine or siloxane-containing moisture curable resin.

2. The thermal transfer printing process according to claim 1 wherein said polyvinyl acetal is selected from the group consisting of polyvinyl formal, acetoacetalized polyvinyl alcohol and propionacetalized polyvinyl alcohol.

3. The thermal transfer printing process according to claim 1 wherein said printing head is a thermal head.

4. The thermal transfer printing process according to claim 1 wherein said polyvinyl acetal has an acetalization degree of 50 mol % or more.

5. The thermal transfer printing process according to claim 1 wherein said polyvinyl acetal has a flow softening point of 80° to 250° C.

6. The thermal transfer printing process according to claim 1 wherein said fluorine-containing moisture curable resin is a fluorine-containing acrylsilicon resin.

7. The thermal transfer printing process according to claim 1 wherein said siloxane-containing moisture curable resin is a siloxane-containing acrylsilicon resin.

* * * * *